US010711392B2

(12) United States Patent
Xu et al.

(10) Patent No.: US 10,711,392 B2
(45) Date of Patent: Jul. 14, 2020

(54) PAD-STEAM BLEACHING METHOD FOR FABRIC BASED ON TBLC-ACTIVATED HYDROGEN PEROXIDE SYSTEM

(71) Applicants: Jiangnan University, Wuxi (CN); Jiangsu Lianfa Textile Co., Ltd, Nantong (CN)

(72) Inventors: Changhai Xu, Wuxi (CN); Minghua Peng, Wuxi (CN); Yongjun Yu, Nantong (CN); Wenjun Tang, Nantong (CN); Jinlong Yao, Nantong (CN); Zhonglin Xiang, Nantong (CN); Jinmei Du, Wuxi (CN); Chang Sun, Wuxi (CN); Xiaohong Qian, Nantong (CN); Sen Chen, Nantong (CN); Yueling Sun, Nantong (CN); Chang'e Zhou, Wuxi (CN)

(73) Assignee: Jiangnan University, Wuxi (CN)

( * ) Notice: Subject to any disclaimer, the term of this patent is extended or adjusted under 35 U.S.C. 154(b) by 0 days.

(21) Appl. No.: 16/288,659

(22) Filed: Feb. 28, 2019

(65) Prior Publication Data

US 2019/0194863 A1 Jun. 27, 2019

Related U.S. Application Data

(63) Continuation of application No. PCT/CN2017/109471, filed on Nov. 6, 2017.

(30) Foreign Application Priority Data

Nov. 22, 2016 (CN) ..... 2016 1 1025859

(51) Int. Cl.
*D06L 4/13* (2017.01)
*D06L 4/12* (2017.01)

(52) U.S. Cl.
CPC . *D06L 4/13* (2017.01); *D06L 4/12* (2017.01)

(58) Field of Classification Search
CPC ..... D06L 4/12; D06L 4/13
See application file for complete search history.

(56) References Cited

U.S. PATENT DOCUMENTS 5,932,532 A 8/1999 Ghosh et al.

FOREIGN PATENT DOCUMENTS

| | | | | | |
|---|---|---|---|---|---|
| CN | 102486003 A | * | 6/2012 | ..... | D06L 1/14 |
| CN | 102486003 A | | 6/2012 | | |
| CN | 102858936 A | | 1/2013 | | |
| CN | 103046383 A | | 4/2013 | | |
| CN | 103225199 A | * | 7/2013 | ..... | D06L 4/12 |
| CN | 103225199 A | | 7/2013 | | |
| CN | 106381679 A | | 2/2017 | | |

OTHER PUBLICATIONS

Chen et al. Recognizing a limitation of the TBLC-activated peroxide system on low-temperature cotton bleaching. Carbohydrate Polymers, 140(2016)1-5, available online Dec. 12, 2015.*

Cha et al. Derwent 2013-F64387, 2013.*

Chen Wenhua et al. Recognizing a limitation of the TBLC-activated peroxide system on low-temperature cotton bleaching Carbohydrate Polymers, Apr. 20, 2016, vol. 140, ISSN:0144-8617, Paragraph 3 of left col. and paragraph 2 of right col. of p. 2, Paragraph 1 of left col. and Figure 3 of right col. of p. 4.

* cited by examiner

*Primary Examiner* — Amina S Khan
(74) *Attorney, Agent, or Firm* — IPro, PLLC

(57) ABSTRACT

The present disclosure discloses a pad-steam bleaching method based on a TBLC-activated hydrogen peroxide system, and belongs to the field of pretreatment processing of textiles. According to the pad-steam bleaching method based on the TBLC-activated hydrogen peroxide system, TBCC and $H_2O_2$ are compounded with a weak base to prepare a TBCC/$H_2O_2$/weak base system for performing near-neutral bleaching on cotton fabrics; the fabrics are padded and then steamed to be bleached. By the method disclosed by the present disclosure, the whiteness of fabric treated for 2 minutes by a TBCC/$H_2O_2$/sodium citrate padding and steaming system is significantly superior to that of fabric treated for 60 minutes by an $H_2O_2$/NaOH dip bleaching system. The CIE whiteness of the fabric reaches 77 and above, the fabric wettability after treatment is also improved, the damage of the fabric is smaller, and the amount of water used by the method is small. The fabric only needs to have a certain wet pick-up, and a large amount of fabric can be treated by a certain volume of solution, which effectively reduces waste water treatment, saves energy and protects the environment; the method requires a short treatment time and has high bleaching efficiency.

8 Claims, No Drawings

PAD-STEAM BLEACHING METHOD FOR FABRIC BASED ON TBLC-ACTIVATED HYDROGEN PEROXIDE SYSTEM

TECHNICAL FIELD

The disclosure herein relates to a pad-steam bleaching method for fabric based on a TBLC-activated hydrogen peroxide system, and belongs to the field of pretreatment processing of textiles.

BACKGROUND

Cotton fabrics are bleached prior to dyeing and finishing to remove natural pigment impurities from cotton fibers. The conventional bleaching process of cotton fabrics is usually performed with hydrogen peroxide ($H_2O_2$) as an oxidant at high temperature (>95° C.) and alkaline (~pH 11) conditions, which has the disadvantages of high energy consumption, heavy waste water treatment burden and severe fiber damage.

It has been reported that the bleach activator N-[4-(trialkylammoniummethylene)benzoyl]lactam chloride (TBLC) can react with $H_2O_2$ in a near-neutral water solution to form a more active 4-(trialkylammoniummethylene)peroxybenzoic acid in situ, which enables cotton fabrics to obtain a better bleaching effect at a low temperature and the pH close to 7, and to obtain good whiteness. In long-term practice, application of the TBLC-activated hydrogen peroxide bleaching system in a thermal bleaching process has gradually matured, and the performance of the fabric has been able to meet the corresponding requirements. The cold pad-batch process has many advantages such as low energy consumption, low water consumption, high flexible productivity, high process adaptability and small loss of fabric strength. However, when TBCC/$H_2O_2$ is applied to a cold pad-batch bleaching process, experimental results show that when the concentration of TBCC (N-4-(triethylammoniummethylenebenzoyl)caprolactam chloride) is increased to the range of 25-100 g/L, the bleaching effect is unexpectedly weakened; dynamic adsorption experiments show that this is likely due to the relatively high TBCC concentration, and because the adsorption of TBCC and peroxy acid on cotton fabrics increases, the peroxyacid activity is relatively low, thus limiting the bleaching efficiency; such limitation is particularly fatal in the cotton fabric cold pad-batch bleaching process that requires high concentrations of TBCC.

Therefore, there is a need to improve the bleaching process to overcome the problems of unstable bleaching effect of the TBLC-activated hydrogen peroxide system and long time required for a cold pad-batch implementation process in the cold pad-batch bleaching process which currently requires higher concentrations of chemicals.

SUMMARY

In order to solve the above problems, the present disclosure combines padding and steaming to construct a pad-steam bleaching process based on an N-[4-(trialkylammoniummethylene)benzoyl]lactam chloride (TBLC)-activated hydrogen peroxide system, to solve the problems of TBLC existing in the cold pad-batch bleaching process, improve the utilization efficiency of the TBLC-activated hydrogen peroxide system in fabric bleaching, shorten the production cycle, and obtain a satisfactory bleaching effect in a short time.

The present disclosure compounds TBLC and $H_2O_2$ with the weak base, getting a TBLC/$H_2O_2$/weak base system, used for performing near-neutral bleaching on cotton fabrics. After the cotton fabrics are cold-padded, the cotton fabrics are steamed to quickly activate TBLC to accelerate the bleaching rate, reduce the stacking time of the cotton fabrics in the cold pad-batch process, and bleach the cotton fabrics in a short time. The degree of whiteness, water absorbency and strength of the bleached fabric are evaluated in the present disclosure.

The pad-steam bleaching technological method based on the activated hydrogen peroxide system comprises the following steps: dipping the fabric in a solution system containing the activator TBLC, peroxide $H_2O_2$ and a weak base, immediately performing cold padding, then performing steaming for 2-6 min, and performing water washing, wherein the concentration of TBLC is 25-100 g/L.

In one embodiment of the present disclosure, the structural formula of the activator TBLC (N-[4-(trialkylammoniummethylene)benzoyl]lactam chloride) is as follows, wherein n is 1-5, $R_1$, $R_2$ and $R_3$ are hydrogen atoms or alkyl groups containing 1-7 carbon atoms:

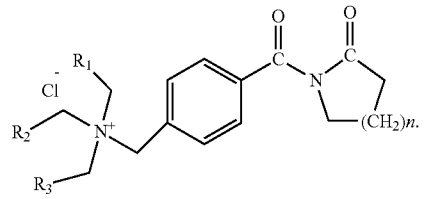

In one embodiment of the present disclosure, the activator TBLC (N-[4-(trialkylammoniummethylene)benzoyl]lactam chloride) is specifically N-[4-(triethylammoniummethylene)benzoyl]lactam chloride with a structural formula as follows:

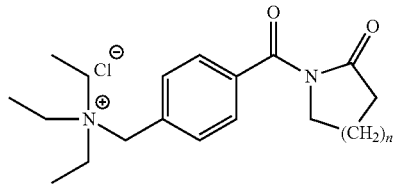

In one embodiment of the present disclosure, the weak base can be inorganic weak bases such as sodium acetate, sodium hydrogen phosphate, sodium dihydrogen phosphate, sodium citrate, sodium bicarbonate and sodium carbonate, or organic bases such as ethylamine, dimethylamine, triethylamine and butyl amine.

In one embodiment of the present disclosure, the weak base is sodium citrate or sodium bicarbonate.

In one embodiment of the present disclosure, the solution system is prepared by adding the activator TBLC and $H_2O_2$ to a water solution containing a sufficient amount of weak base, wherein the mol ratio of the $H_2O_2$ to the TBLC is (10:1)-(1:1).

In one embodiment of the present disclosure, the mol ratio of the $H_2O_2$ to the TBLC is (2:1)-(1:1).

In one embodiment of the present disclosure, the mol ratio of the TBLC to the $H_2O_2$ to the weak base is 1:1.2:1.4.

In one embodiment of the present disclosure, the concentration of the TBLC is 50 g/L.

In one embodiment of the present disclosure, the activator TBLC and the $H_2O_2$ are added to a water solution containing a sufficient amount of weak base, wherein the TBLC is 50 g/L, and the $H_2O_2$ (30%, w/v) is 18.4 g/L.

In one embodiment of the present disclosure, the solution system also contains a stabilizer and a penetrant.

In one embodiment of the present disclosure, the amount of the stabilizer used is 0.1-5 g/L, and the amount of the penetrant used is 0.1-5 g/L.

In one embodiment of the present disclosure, in the solution system, the content of the stabilizer is 5 g/L and the content of the penetrant is 5 g/L.

In one embodiment of the present disclosure, in the solution system, the TBLC is 50 g/L, the $H_2O_2$ (30%, w/v) is 18.4 g/L, the weak base is 56 g/L, the stabilizer is 5 g/L and the penetrant is 5 g/L.

In one embodiment of the present disclosure, steaming is performed at normal pressure for 2 min.

In one embodiment of the present disclosure, the fabric is pure and blended fabrics of cotton, viscose fiber, bamboo fiber, hemp fiber, etc., or a fiber blended fabric of the pure and blended fabrics with silk, wool, polyester, nylon, acrylic, polypropylene, vinylon, etc.

In one embodiment of the present disclosure, the fabric is cotton fabric.

In one embodiment of the present disclosure, the mass of the fabric is 1%-100% of the mass of the solution system, and the pick-up is 10%-110%.

In one embodiment of the present disclosure, the pick-up of cold-padding is 100% -110%.

In one embodiment of the present disclosure, water washing is performed by taking out the steamed fabric, adding clear water which is 10-20 times of the fiber weight, and performing washing for 10-30 minutes.

Advantages and Effects of the Present Disclosure (1) The present disclosure applies the TBLC-activated hydrogen peroxide system to the pad-steam bleaching process of cotton fabrics. In the TBCC/$H_2O_2$/weak base system, the CIE whiteness of the fabric after short-time treatment can reach 75 and above; the fabric is bleached by the TBCC/$H_2O_2$/weak base system and refined woven cotton fabric is treated by dip bleaching in the $H_2O_2$/NaOH system at 95° C., and the whiteness of the fabrics is greatly improved after treatment; the whiteness of the fabric treated by the TBCC/$H_2O_2$/weak base padding and steaming system for 2 minutes is similar to that of the fabric treated by the $H_2O_2$/NaOH dip bleaching system for 60 minutes.

(2) The wettability of the fabric treated by the TBCC/$H_2O_2$/weak base padding and steaming system is also improved, and the damage of the fabric is small.

(3) Dyeing experiments of the method disclosed by the present disclosure show that the dyeing property of the fabric treated by the TBCC/$H_2O_2$/weak base padding, steaming and bleaching system can completely achieve the treatment effect of the $H_2O_2$/NaOH bleaching system, and can meet the requirements of dyeing processing.

(4) The method has low water consumption. The fabric only needs to have a certain pick-up, meaning that a large amount of fabric can be treated by a certain volume of solution, which effectively reduces waste water treatment, saves energy and protects the environment. Furthermore, the method requires a short processing time and has high bleaching efficiency.

DETAILED DESCRIPTION (1) Measurement of Whiteness

The CIE whiteness index (WI) of the fabric is measured according to AATCC Test Method 110-2011. A sample is folded twice and placed on a Datacolor 650 spectrophotometer to measure the CIE whiteness of the fabric, then the sample fabric is measured again when rotated by 90 degrees for 4 times, and the results are averaged.

(2) Wettability

The wettability of the fabric is measured in accordance with the AATCC Test Method 79-2010 "Hygroscopicity of Textiles" test method. Specifically, a test sample is placed in a constant temperature and humidity chamber for 24 hours, and the parameters of the constant temperature and humidity chamber are set to, humidity: 65%, temperature: 21° C. A drop of water is dropped from a certain height onto the surface of the fabric, and the time the water droplet takes to completely disappear is recorded. The cloth surface needs to be flat. Four relatively uniform points are selected, and the recorded data is averaged. The shorter the time required for the water droplet to completely disappear is, the better the water absorbancy of the fabric is.

(3) Degree of Polymerization

The degree of polymerization (DP) can be used to measure the molecular weight of cotton fibers. According to the change of the degree of polymerization of the cotton fabric before and after the treatment, the damage of the fabric after the cotton fabric is treated can be judged. Generally, if the degree of polymerization of the sample after treatment is reduced as compared with the original sample, the fiber is damaged, and the higher the degree of polymerization is reduced, the more serious the damage of the fiber is.

(4) Dyeing Property of Fabric

The purpose of bleaching is to provide a good white matrix for subsequent dyeing and finishing. The fabric has to have good whiteness to obtain a corresponding color when the fabric is dyed into light colored fabric. The wettability of the fabric largely affects the dyeing property of the fabric. If the wettability of the fiber is poor, the speed of the dye moving from a dyeing liquid to the fabric is slow. If the wettability of the fabric is not uniform, the dye molecules on the fabric will be unevenly distributed, the color difference will be large, and dyeing will be uneven. If the fabric is subjected to large damage during the bleaching process, in the subsequent treatment, overlarge tension or chemical reagent influence may cause holes and defects in the fabric. Thus, the dyeing property of the fabric can further measure the bleaching effect of the fabric. The dyeing property can more fully reflect the treatment effect of the fabric. In this experiment, the fabrics with the same whiteness after bleaching treatment by different systems are selected, and the fabrics are placed in the same dyeing solution, and subjected to the same dyeing process. Finally, the dyeing properties of the fabrics are judged according to the color difference of the fabrics and the color characteristic values. Reactive dyes can form a covalent bond with cellulose, have good color fastness and are suitable for dyeing cotton fabrics. In this experiment, two different gray colors are prepared from the three primary color reactive dyes of Wande, and the same bath is used for competitive dyeing.

Example 1

Fabric: Cotton knitted fabric (133 g/m$^2$).

Formula: TBCC, $H_2O_2$ and sodium citrate in mol ratio of 1:1.2:1.4, wherein the TBCC is 50 g/L, the stabilizer DM-1403 is 1 g/L and the penetrant JFC is 1 g/L.

Pick-up: 110%.

Steaming: Respectively performing treatment for 2 min, 4 min and 6 min, and measuring the fabric bleaching effects of treatment for different time.

The results are as shown in table 1.

Example 2

Fabric: Cotton knitted fabric (133 g/m$^2$).

Formula: TBCC, $H_2O_2$ and sodium citrate in mol ratio of 1:1.2:1.4, wherein the stabilizer DM-1403 is 1 g/L, the penetrant JFC is 1 g/L, and the TBCC is respectively 25 g/L and 75 g/L.

Pick-up: 100%.

Steaming time: 2 min.

The results are as shown in table 1.

TABLE 1

Bleaching Effects of Steaming for Different Time.

| Samples | Whiteness (CIE) | Degree of Polymerization | Wettability, s |
|---|---|---|---|
| Raw fabric | 30.30 | 4152 ± 30 | 4-6 |
| Example 1, steaming for2 min | 80.45 | 4050 ± 52 | <1 |
| Example 1, steaming for 4 min | 82.34 | 3942 ± 28 | <1 |
| Example 1, steaming for 6 min | 82.12 | 3867 ± 31 | <1 |
| Example 2, TBCC 25 g/L | 74.13 | 4111 ± 22 | <1 |
| Example 2, TBCC 75 g/L | 83.09 | 3998 ± 28 | <1 |
| Sodium bicarbonate group | 72.78 | 4002 ± 22 | <1 |
| Conventional hydrogen peroxide bleaching, 60 min | 73.28 | 2365 ± 74 | <1 |

In the sodium bicarbonate group, sodium citrate in Example 1 is replaced with sodium bicarbonate, steaming is performed for 2 min, and other conditions are the same as those in Example 1. As can be seen from Table 1, the whiteness of the fabric treated with the TBCC/$H_2O_2$/sodium citrate system is increased by about 12% compared with the TBCC/$H_2O_2$/$NaHCO_3$ system.

In the conventional hydrogen peroxide bleaching method, the $H_2O_2$ (30% w/v) is 6 g/L, the NaOH is 3 g/L, the penetrant JFC is 1 g/L, the stabilizer DM-1403 is 1 g/L, the temperature is 95° C., the rotation speed is 30 r/min, the bath ratio is 1:20, and treatment is performed for 10 min, 20 min, 30 min, 40 min, 50 min and 60 min. After the experiments are completed, the samples are thoroughly cleaned with a large amount of deionized water to prevent the residual surfactant from adversely affecting the subsequent performance test, and dried under natural conditions for later use; wherein the whiteness after treatment for 10 min, 20 min, 30 min, 40 min and 50 min are 55.72, 64.34, 68.91, 71.22 and 72.78, respectively.

In addition, the disclosure compares the effects of different padding and steaming systems on the bleaching effects. Among them, refined fabrics (CIE whiteness is 30.30) are respectively bleached by a TBCC/$H_2O_2$/sodium citrate padding and steaming system and an $H_2O_2$/NaOH padding and steaming system. The process parameters and conditions of the two systems are shown in Table 2, and the amount of $H_2O_2$ (30%, w/v) in the two systems is always consistent.

The results show that the whiteness of the fabric bleached by the $H_2O_2$/NaOH padding and steaming system is significantly higher than that before bleaching, and the whiteness increases with the steaming time. When the steaming time is prolonged to 10 minutes, the whiteness can reach 61.96, while the whiteness can reach 80.65 by steaming for 2 minutes by the TBCC/$H_2O_2$/sodium citrate padding and steaming system.

TABLE 2

Process Formulae and Conditions of TBCC/$H_2O_2$/Sodium Citrate Padding and Steaming System and $H_2O_2$/NaOH Padding and Steaming System.

| Reagents etc. | Amount used: TBCC/$H_2O_2$/sodium citrate padding and steaming system | Amount used: $H_2O_2$/NaOH padding and steaming system |
|---|---|---|
| $H_2O_2$ (30%, w/v) (g/L) | 18.4 | 18.4 |
| NaOH, g/L | 0 | 5.6 |
| TBCC (g/L) | 50 | 0 |
| Sodium citrate (g/L) | 56 | 0 |
| Penetrant JFC (g/L) | 5 | |
| Stabilizer DM--1403 (g/L) | 5 | |
| Pick-up (%) | 100%-110% | |

Example 3

Fabric: Cotton knitted fabric (133 g/m$^2$).

Formula: TBCC, $H_2O_2$ and weak base in a mol ratio of 1:1.2:1.4, wherein the TBCC is 50 g/L, the stabilizer DM-1403 is 1 g/L and the penetrant JFC is 1 g/L.

Pick-up: 110%.

Steaming time: 2 min.

The used weak bases are respectively sodium acetate, sodium carbonate, ethylamine and triethylamine.

The fabric bleaching effects under different conditions are measured, and the results are shown in Table 3.

TABLE 3

Bleaching Effects under Different Weak Bases.

| Weak Bases | Whiteness (CIE) |
|---|---|
| Sodium acetate | 70.72 |
| Sodium carbonate | 70.63 |
| Ethylamine | 67.22 |
| Triethylamine | 68.29 |

Example 4

Fabric: Regenerated bamboo viscose fiber (139 g/m$^2$).

Formula: TBCC, $H_2O_2$ and sodium citrate in a mol ratio of 1:1.2:1.4, wherein the stabilizer DM-1403 is 5 g/L, the penetrant JFC is 5 g/L, and the TBCC is respectively 25 g/L and 100 g/L.

Pick-up: 100%.

Steaming time: 2 min.

The results are shown in table 4, wherein the conventional hydrogen peroxide bleaching method is consistent with Table 1.

TABLE 4

Bleaching Effects under Different Treatment Conditions.

| Samples | Whiteness (CIE) | Degree of Polymerization |
|---|---|---|
| Raw fabric | 10.77 | 419 |
| Bleaching according to the example | 64.85 | 380 |
| Conventional hydrogen peroxide bleaching | 59.29 | 206 |

The disclosure described and claimed herein is not to be limited in scope by the specific aspects herein disclosed. Any person skilled in the art can make modifications without departing from the spirit and scope of the disclosure. The scope of protection of the present disclosure should therefore be defined by the claims.

What is claimed is:

1. A method for pad-stream bleaching of fabric, which comprises:

dipping a fabric in a solution system comprising an activator N-[4-(trialkylammoniummethylene)benzoyl] lactam chloride (TBLC), $H_2O_2$, and a weak base, cold padding the fabric immediately following the dipping, steaming the fabric for 2-6 min, and washing the fabric in water, wherein the concentration of TBLC is 25-100 g/L, and the weak base is sodium citrate.

2. The method according to claim 1, wherein the structural formula of the activator TBLC (N[4-(trialkylammoniummethylene)benzoyl]lactam chloride) is as follows, wherein n is 1-5, and $R_1$, $R_2$ and $R_3$ are hydrogen atoms or alkyl groups containing 1-7 carbon atoms:

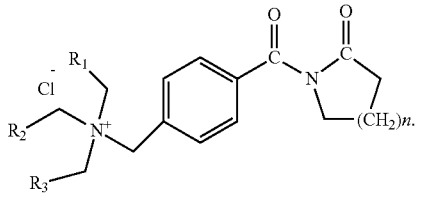

3. The method according to claim 1, wherein the solution system is prepared by adding the activator TBLC and $H_2O_2$ to a water solution containing a sufficient amount of sodium citrate, wherein the molar ratio of the $H_2O_2$ to TBLC is (10:1)-(1:1).

4. The method according to claim 1, wherein the molar ratio of $H_2O_2$ to TBLC is (2:1)-(1:1).

5. The method according to claim 1, wherein the solution system further comprises a stabilizer and a penetrant.

6. The method according to claim 1, wherein steaming is performed at atmospheric pressure for 2 min.

7. The method according to claim 1, wherein the fabric comprises pure or blended fabric selected from the group consisting of: (i) cotton, (ii) viscose fiber, (iii) bamboo fiber, (iv) hemp fiber, silk, wool, polyester, nylon, acrylic, polypropylene, and vinylon.

8. The method according to claim 1, wherein the mass of the fabric is 1%-100% of the mass of the solution system, and the pick-up is 10%-110%.

* * * * *